US009896842B2

(12) United States Patent
Clouse et al.

(10) Patent No.: US 9,896,842 B2
(45) Date of Patent: Feb. 20, 2018

(54) INTERLOCKING PANELS AND RAIL FOR AN ENCLOSURE

(71) Applicant: Kohler Co., Kohler, WI (US)

(72) Inventors: Kathryn Clouse, Howards Grove, WI (US); Divya Agarwal, Kew Gardens, NY (US); Jeffry J. Radke, Neenah, WI (US)

(73) Assignee: KOHLER CO., Kohler, WI (US)

( * ) Notice: Subject to any disclaimer, the term of this patent is extended or adjusted under 35 U.S.C. 154(b) by 43 days.

(21) Appl. No.: 14/977,044

(22) Filed: Dec. 21, 2015

(65) Prior Publication Data

US 2016/0265227 A1 Sep. 15, 2016

Related U.S. Application Data

(60) Provisional application No. 62/130,737, filed on Mar. 10, 2015.

(51) Int. Cl.

| | |
|---|---|
| ***E04B 2/00*** | (2006.01) |
| ***E04B 7/04*** | (2006.01) |
| ***E04B 1/38*** | (2006.01) |
| ***E04C 2/30*** | (2006.01) |
| ***E04C 2/52*** | (2006.01) |
| ***E04D 13/064*** | (2006.01) |
| ***E04H 7/00*** | (2006.01) |
| *E04C 3/04* | (2006.01) |

(52) U.S. Cl.

CPC ..... *E04C 2/46* (2013.01); *E04B 1/38* (2013.01); *E04B 7/04* (2013.01); *E04C 2/30* (2013.01); *E04C 2/521* (2013.01); *E04D 13/064* (2013.01); *E04H 7/00* (2013.01); *E04C 2003/0443* (2013.01)

(58) Field of Classification Search

CPC ..... E04B 7/04; E04B 1/38; E04C 2003/0443; E04C 2/46; E04C 2/521; E04C 2/30; E04H 7/00

USPC ..... 52/293.3, 300, 579, 581

See application file for complete search history.

(56) References Cited

U.S. PATENT DOCUMENTS 3,110,371 A * 11/1963 De Ridder ..... F16B 5/008 105/422
3,349,533 A * 10/1967 Gregoire ..... E04B 2/7854 52/282.2
3,654,640 A * 4/1972 Katzman ..... E04H 4/005 52/241

(Continued)

FOREIGN PATENT DOCUMENTS

| | | |
|---|---|---|
| CA | 1089172 | 11/1980 |
| FR | 2359263 A1 | 2/1978 |

OTHER PUBLICATIONS

Communication from the EPO with the extended European Search Report for corresponding European Patent Application No. 16153357.1 dated Jul. 19, 2016.

*Primary Examiner* — Adriana Figueroa
(74) *Attorney, Agent, or Firm* — Klintworth & Rozenblat IP LLP

(57) ABSTRACT

A rail for an enclosure includes a horizontal leg configured to alternatively secure with a roof and a skid/tank of the enclosure. A first leg of the rail connects perpendicularly to the horizontal leg and a second leg connected perpendicular to the horizontal leg and opposes the first leg. The first leg and the second leg form a channel to receive a wall of the enclosure.

15 Claims, 9 Drawing Sheets

(56) References Cited

U.S. PATENT DOCUMENTS 4,372,089 A * 2/1983 Akesson ..... E04B 1/74 52/236.3
5,479,750 A * 1/1996 Carlberg ..... E04B 5/12 428/192
5,509,242 A 4/1996 Rechsteiner et al.
D447,575 S * 9/2001 Shaw ..... D25/121
6,314,704 B1 * 11/2001 Bryant ..... E04B 1/12 52/271
6,324,796 B1 * 12/2001 Heath ..... E04B 5/026 52/177
6,505,449 B1 * 1/2003 Gregori ..... E04G 23/0218 52/300
7,107,727 B2 * 9/2006 Nelsen ..... E04B 1/003 52/300
7,406,801 B2 * 8/2008 Zeng ..... E04F 15/06 52/177
7,712,260 B2 5/2010 Vardar et al.
7,793,470 B1 * 9/2010 Mathiesen ..... E04F 15/10 404/41
8,739,484 B2 * 6/2014 Antonic ..... E04B 7/04 52/220.1
8,875,459 B2 * 11/2014 Palmeri ..... E04B 2/7407 52/274
2002/0124503 A1 * 9/2002 Stutler ..... E04D 3/405 52/300
2003/0066250 A1 * 4/2003 Moore ..... E04B 7/04 52/93.1
2003/0182886 A1 * 10/2003 Parrish ..... B29C 70/025 52/293.3
2004/0079039 A1 * 4/2004 Shaw ..... E04B 5/12 52/300
2004/0134162 A1 * 7/2004 Douglas ..... E02D 27/02 52/741.1
2007/0186500 A1 * 8/2007 Quirk ..... E04B 5/12 52/300
2014/0000192 A1 * 1/2014 Cramb ..... E04B 1/24 52/220.1
2014/0069032 A1 * 3/2014 Philibert ..... E04B 1/34321 52/79.9

* cited by examiner

INTERLOCKING PANELS AND RAIL FOR AN ENCLOSURE

CROSS-REFERENCE TO RELATED APPLICATION

This application claims the benefit of U.S. Provisional Application Ser. No. 62/130,737, filed Mar. 10, 2015, which is incorporated in its entirety herein.

FIELD

The systems and methods relate to an enclosure and a rail for the enclosure, e.g., an enclosure for a generator.

BACKGROUND

To protect objects from the elements, the objects can be enclosed in an enclosure. The enclosure can also attenuate noise coming from the enclosed object.

SUMMARY

According to one aspect, systems and methods include a rail for use in creating an enclosure. The rail includes a horizontal leg configured to alternatively secure with a roof and a skid/tank. A first leg of the rail connects perpendicularly to the horizontal leg and a second leg connected perpendicular to the horizontal leg and opposes the first leg. The first leg and the second leg form a channel to receive a wall forming a part of the enclosure.

Other systems, methods, features, and advantages will be or will become apparent upon examination of the following figures and detailed description. It is intended that all such additional systems, methods, features, and advantages be included within this description and be protected by the accompanying claims.

BRIEF DESCRIPTION OF THE DRAWINGS

In association with the following detailed description, reference is made to the accompanying drawings, where like numerals in different figures can refer to the same element. The features of the drawings are not necessarily drawn to scale.

DETAILED DESCRIPTION

Figure 1:
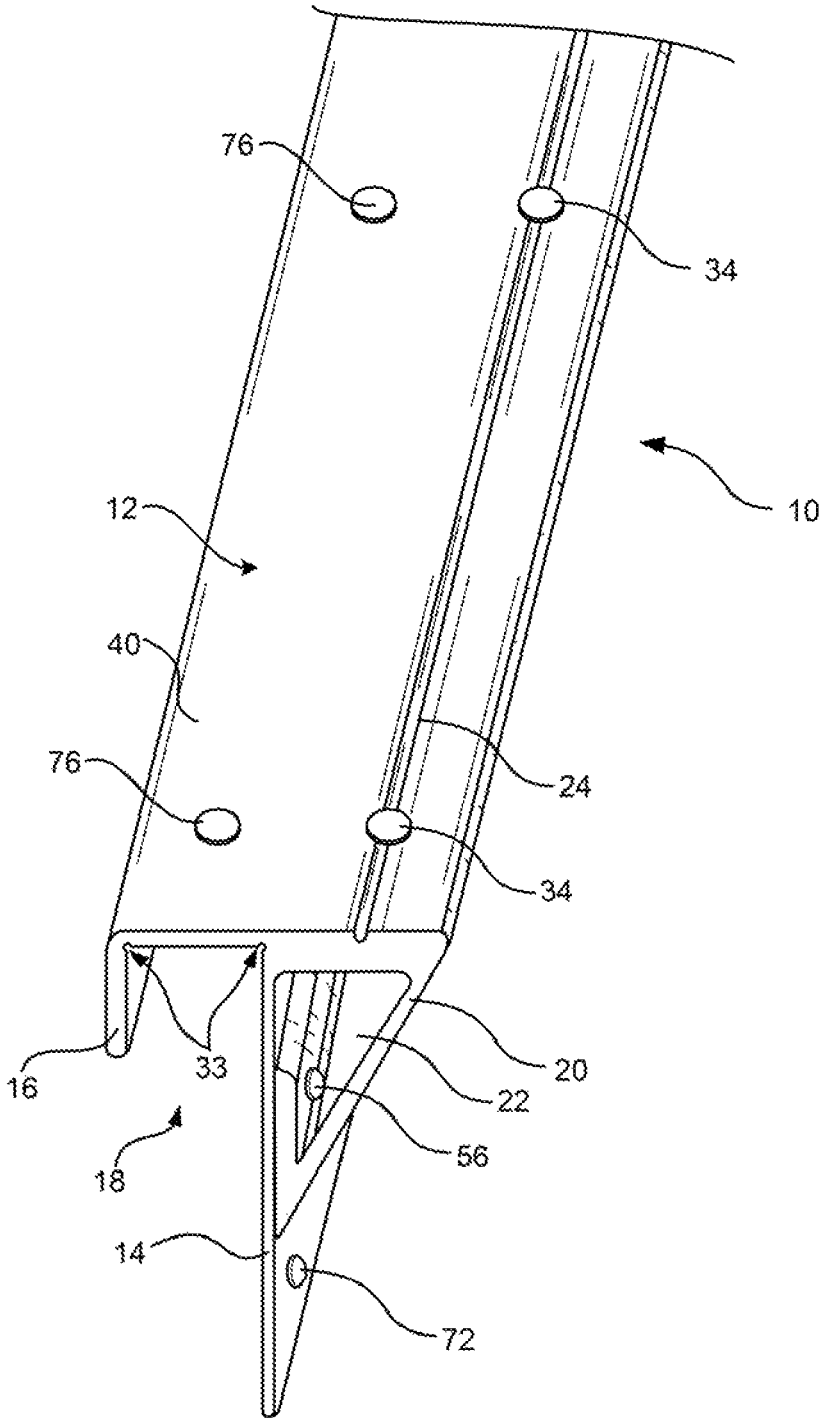
FIG. 1 is a perspective view of an example rail for creating an enclosure.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Figure 2:
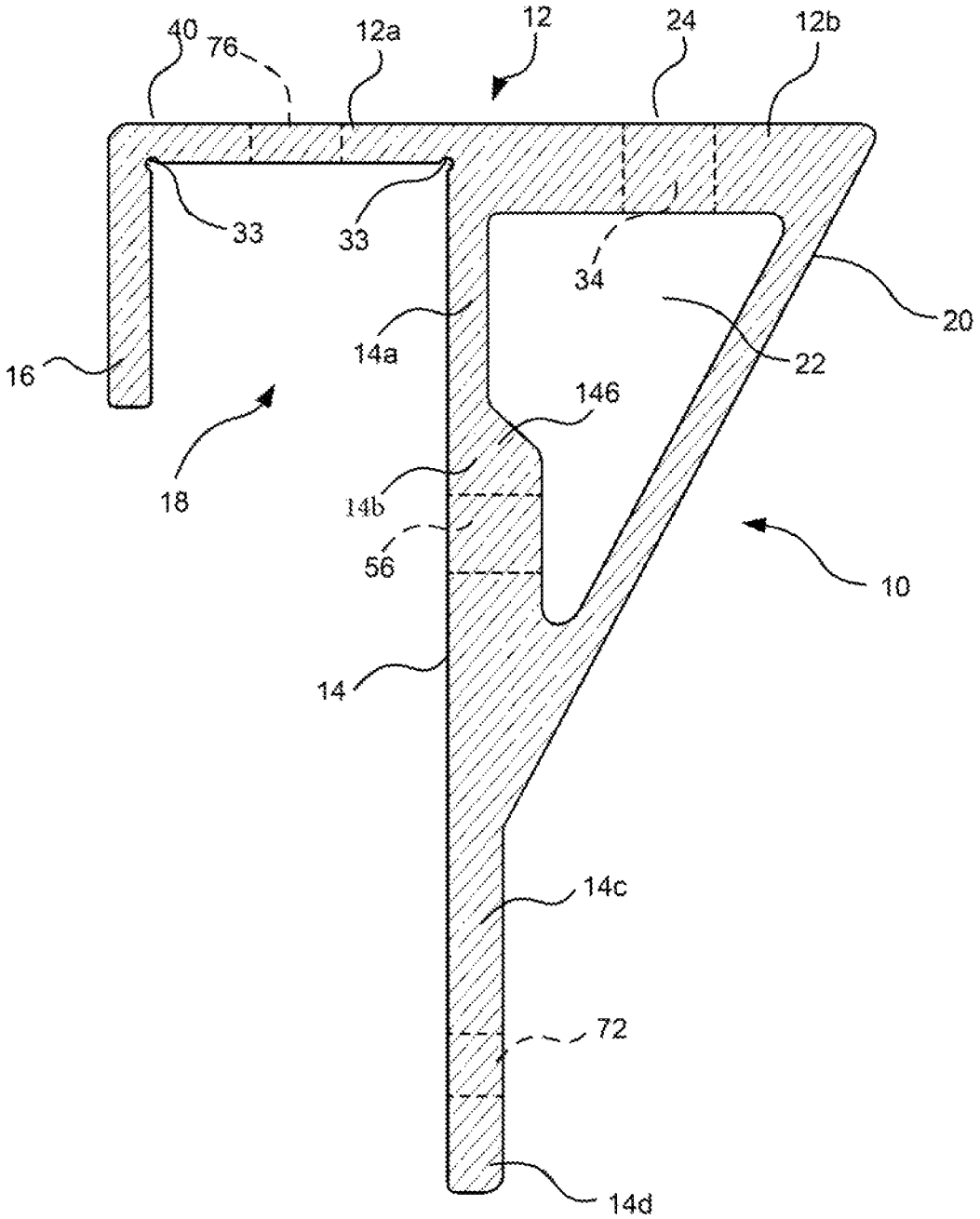
FIG. 2 is a cross sectional side view of the rail of FIG. 1.
Figure 3:
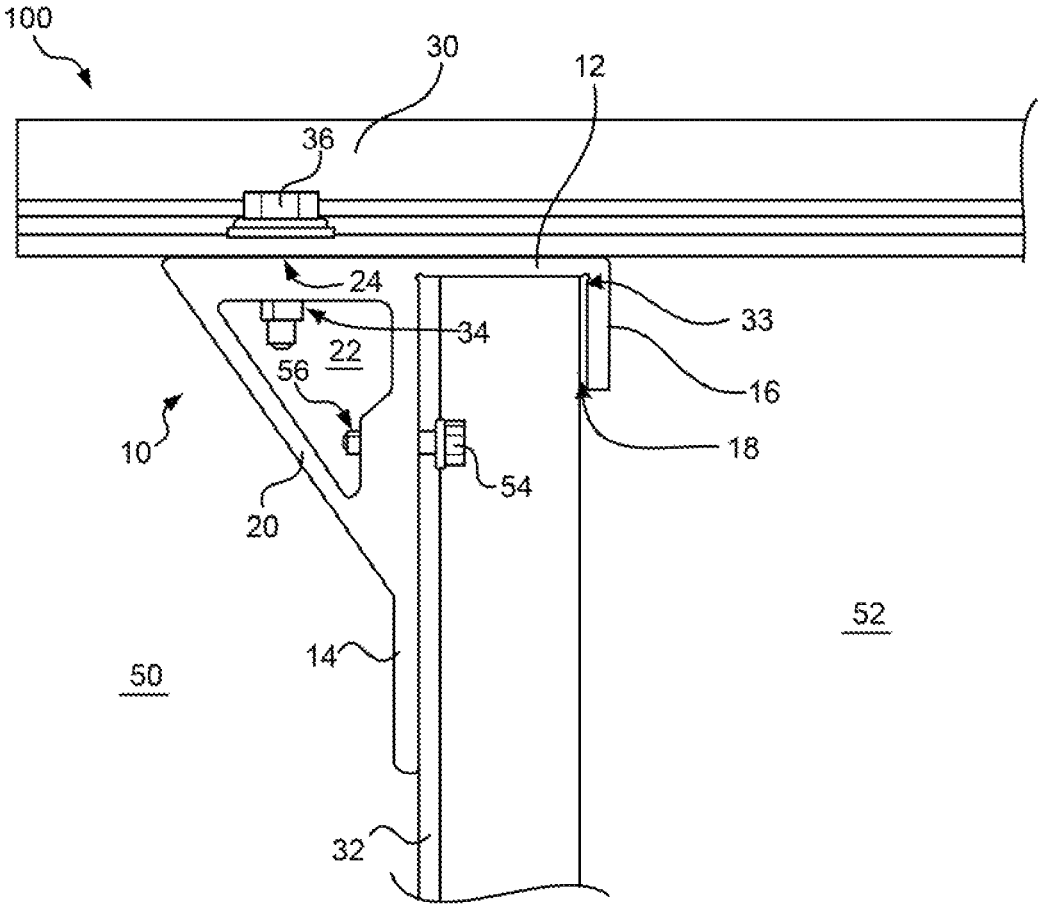
FIG. 3 is a partial side view of the rail connected with a roof and a wall.
Figure 4:
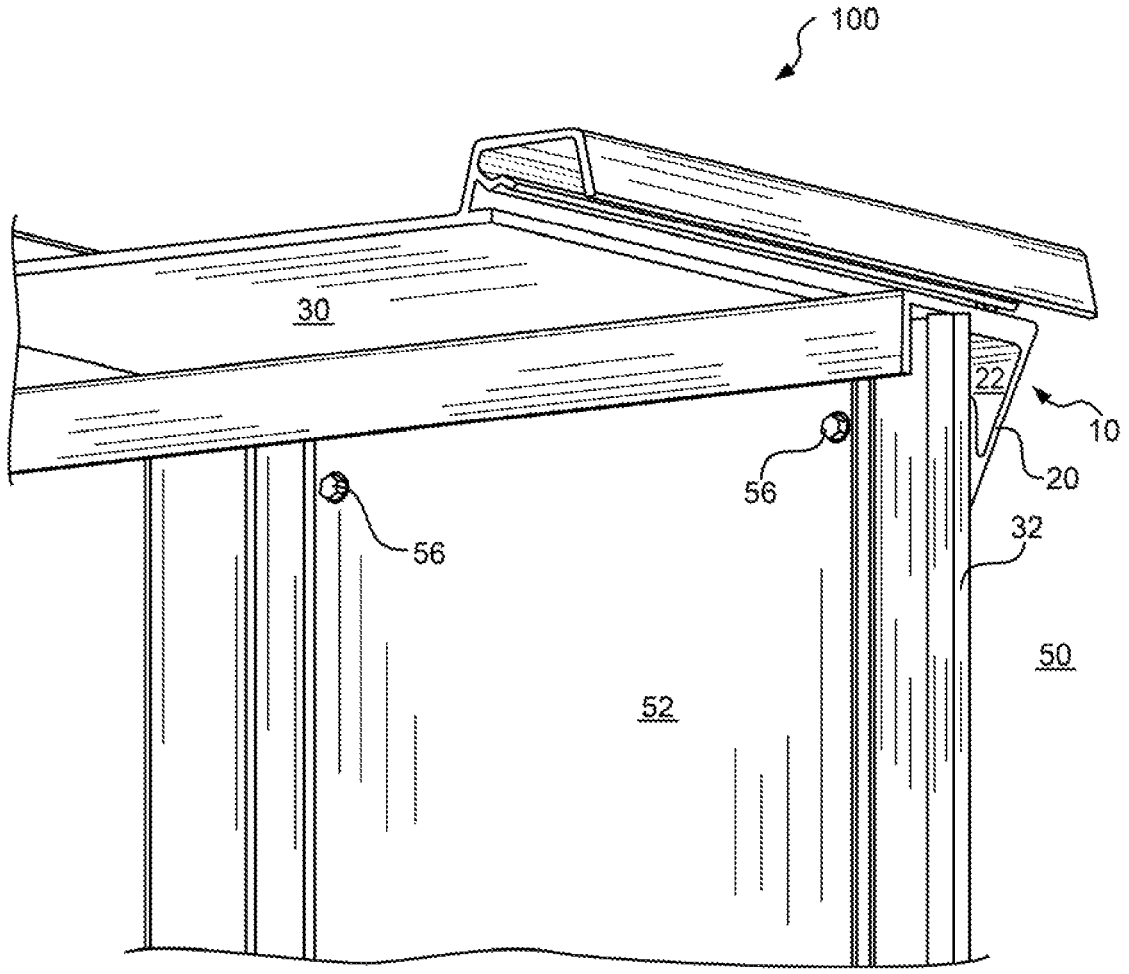
FIG. 4 is a partial side perspective view of the rail secured to a wall.
Figure 5:
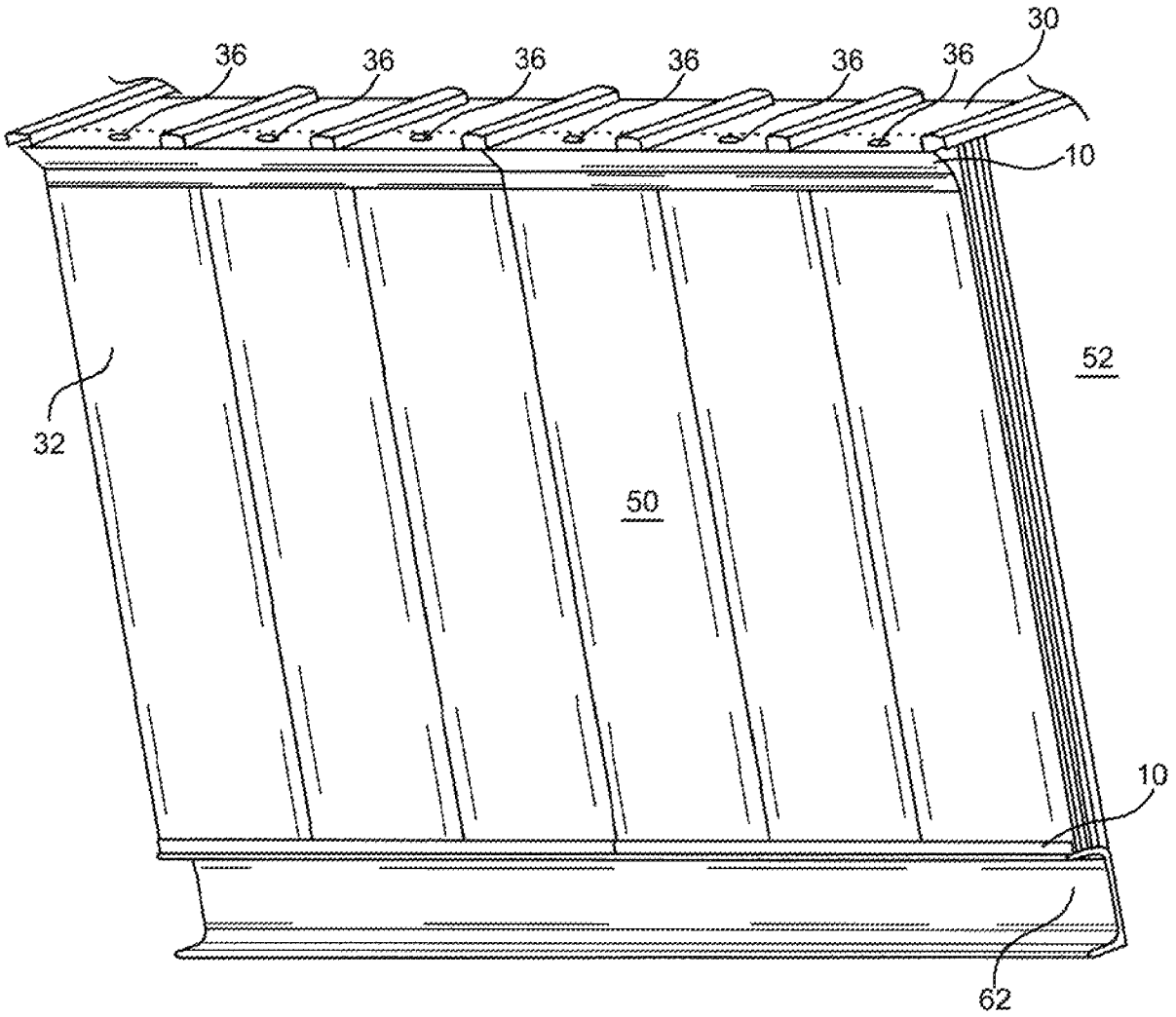
FIG. 5 is a side perspective view of the rail secured to the wall.
Figure 6:
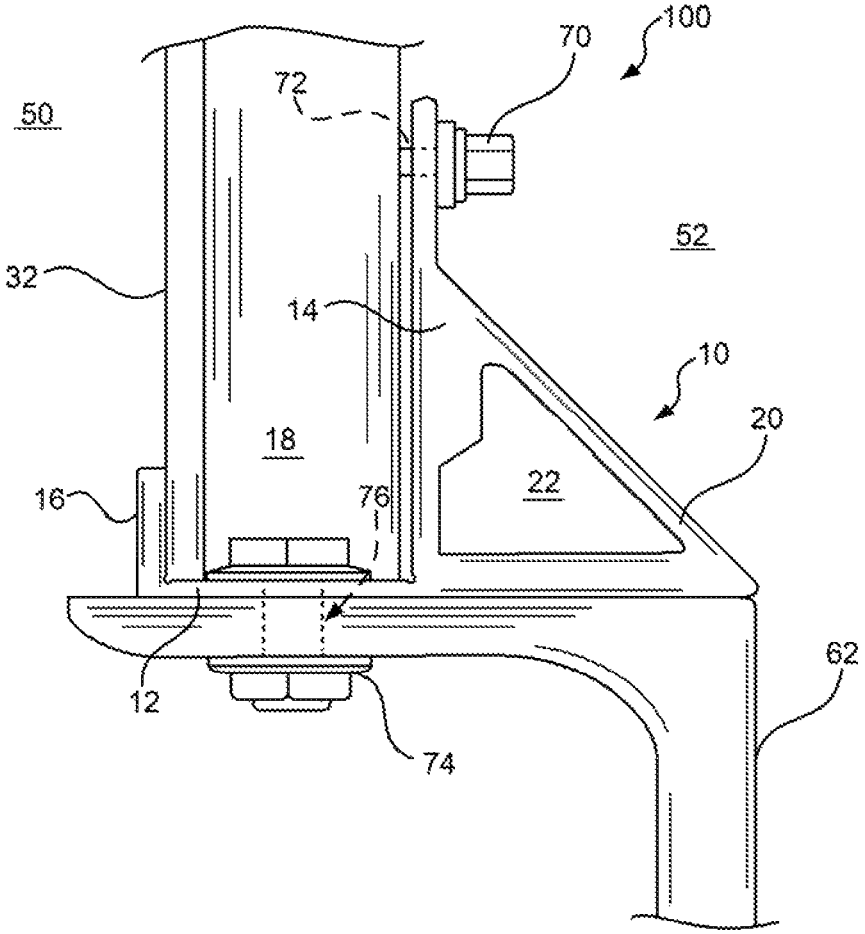
FIG. 6 is a partial side view of the rail securing the wall to a skid/tank.
Figure 7:
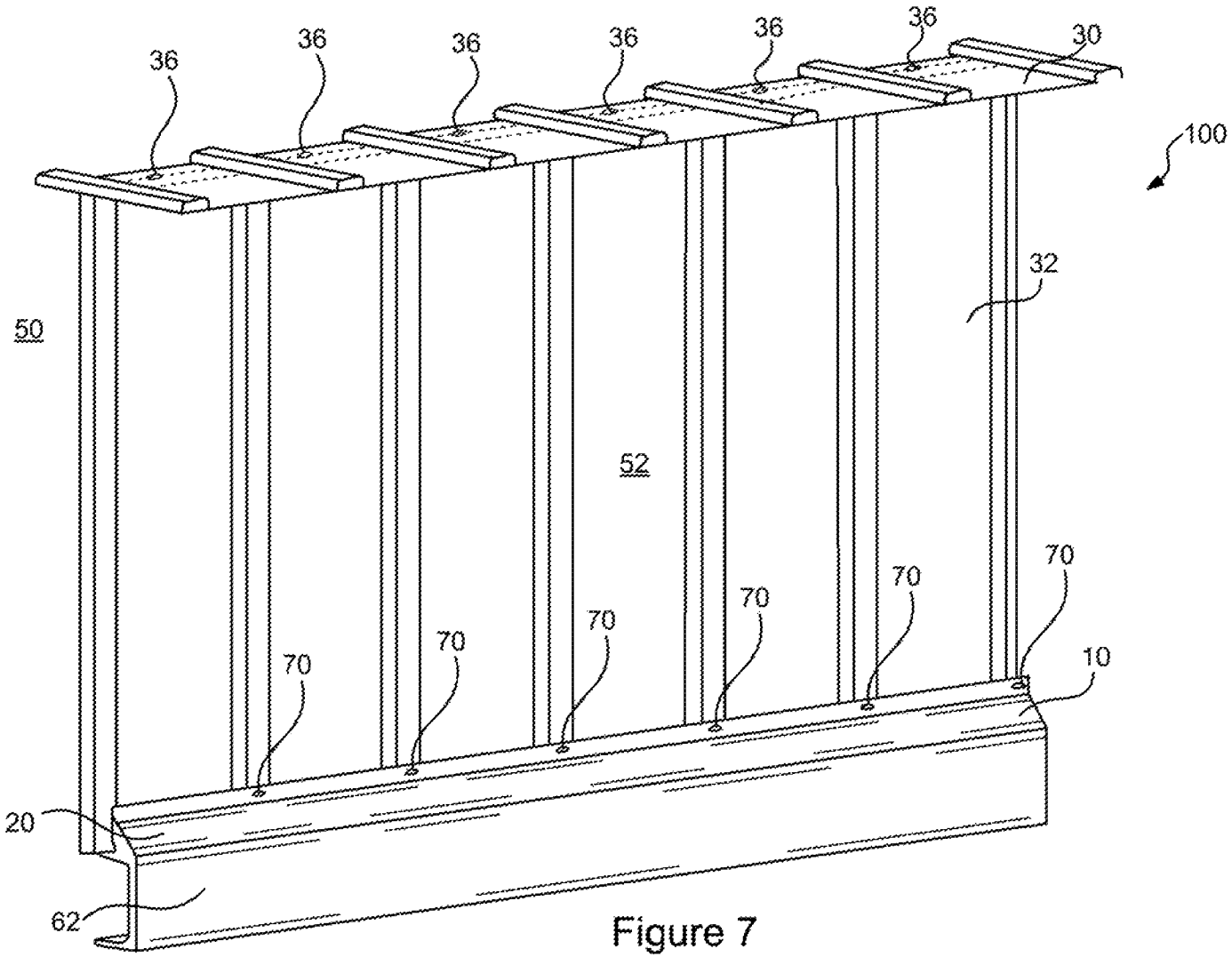
FIG. 7 is a partial perspective view of the rail securing the wall to the skid/tank.

Referring to FIGS. 1 and 2, a rail 10 is provided for creating an enclosure 100. As shown in FIGS. 3-5, the rail 10 can be connected with a roof 30 and one or more walls 32 to form the enclosure 100. As shown in FIGS. 5-7, the rail 10 can be connected to a skid/tank 62. The rail 10 is manufactured by an extrusion process or other manufacturing processes. If manufactured as an extrusion process, the process can be continuous or semi-continuous, and can be done with the material hot or cold. The material for the rail 10 can include one or more of metals, polymers, ceramics, concrete, etc.

As best shown in FIGS. 1 and 2, the rail 10 has a horizontal base leg 12 having first and second opposite edges and first and second opposite ends, a first vertical leg 14 extending from the base leg 12 at approximately the midpoint of the leg 12, a second vertical leg 16 extending from the first edge of the leg 12, and a gusset 20 extending at an angle between the second edge of the leg 12 and the first leg 14. A length is defined between the opposite ends of the base leg 12. The second leg 16 can be shorter in length than the longer first leg 14. The legs 12, 14, 16 define a channel 18. The legs 12, 14 and gusset 20 defines a hollow opening 22. The opening 22 is open at both ends of the rail 10.

The base leg 12 has a first portion 12*a* which extends between the first leg 14 and the second leg 16. The base leg 12 further has a second portion 12*b* which extends between the first leg 14 and the gusset 20. The first portion 12*a* may have a thickness which is less than the thickness of the second portion. At least one aperture 76 is formed through the first portion 12*a* and is in communication with the channel 18. At least one aperture 34 is formed through the second portion 12*b* and is in communication with the opening 22. The base leg 12 includes a notch 24 which extends along its length. In one example, the notch 24 includes a generally triangular shape but other shapes can be used including rectangular, circular, oval, etc.

The first leg 14 has a first portion 14*a* which has a predetermined thickness and which extends from the base leg 12, a second portion 14*b* which extends from the first portion 14*a* to the end of the gusset 20, and a third portion 14*c* which extends from the second portion 14*b* to a free end 14*d* of the first leg 14. The first and third portions 14*a*, 14*c* may have a thickness which is less than a thickness 146 of the second portion 14*b*. At least one aperture 56 is formed through the second portion 14*b* and is in communication with the opening 22. At least one aperture 72 is formed through the third portion 14*c*.

An undercut 33 is formed between the base leg 12 and each of the first and second legs 14, 16. The undercuts 33 may be generally semi-circular shaped or other shapes.

A first implementation of the rail 10 is described with the rail 10 being connected to an upper end of a wall 32 as shown in FIGS. 3-5 to form the enclosure 100. The upper end of the wall 32 is inserted into the channel 18 such that the outer surface of the wall 32 is proximate to, and may abut against, the first leg 14 and the inner surface of the wall 32 is proximate to, and may abut against, the second leg 16. The base leg 12 is above the wall 32. The gusset 20 is on the outside 50 of the wall 32. The wall 32 is fastened to the rail 10 by passing a fastener 54 through the wall 32 and through each aperture 56. The thicker second portion 14*b* allows for proper thread engagement of the fastener 54. The thinner portions 14*a*, 14*c* provide support while saving material. The rail 10 acts as a cosmetic cover for raw edges of the wall 32. The second leg 16 also acts as a hook which holds the wall 32 in place during the fastening of the roof 30 as described herein to the rail 10. The undercuts 33 provide the rail 10 with clearance for the wall 32 when the wall 32 is inserted into the channel 18.

The roof 30 is laid on the upper surface 40 of the base leg 12. If desired, the notch 24 provides a guide edge for caulking before the roof 30 is placed on the base leg 12. The roof 30 is fastened to the rail 10 by passing a fastener 36 through the roof 30 and through each aperture 34. The thicker second portion 12*b* allows for proper thread engagement of the fastener 36. When the roof 30 is fastened to the rail 10, the aperture(s) 34 are a possible entry point for water to enter the rail 10. Since the apertures 34 are located above the hollow opening 22, and the opening 22 is located on the outside 50 of the enclosure 100, e.g., outside the wall 32 of the enclosure 100, water flows through the hollow opening 22 and out an end of the rail 10, and does not have a path to enter inside 52 the enclosure 100. The hollow opening 22 allows the rail 10 to act as a gutter allowing rain and other water to drain out of the ends and at unsealed seams of the rail 10. The hollow opening 22 can also reduce a cost to manufacture the rail 10 by reducing a material to produce the rail 10. The gusset 20 transfers load from the roof 30 to the wall 32.

A second implementation of the rail 10 is described with the rail 10 being connected to a lower end of a wall 32 and to a skid/tank 62 as shown in FIGS. 5-7. To do this, the rail 10 is rotated 180 degrees from roof 30 to skid/tank 62 so that the gusset 20 points to the inside 52 of the enclosure 100 acting as a load transfer mechanism from the wall 32 to the skid/tank 62. The lower end of the wall 32 is inserted into the channel 18 such that the inner surface of the wall 32 is proximate to, and may abut against, the first leg 14 and the outer surface of the wall 32 is proximate to, and may abut against, the second leg 16. The base leg 12 is below the wall 32. The gusset 20 is on the inside 52 of the wall 32. The wall 32 is fastened to the rail 10 by passing a fastener 70 through the wall 32 and through each aperture 72. The rail 10 acts as a cosmetic cover for raw edges of the wall 32. The second leg 16 also acts as a hook which holds the wall 32 in place during the fastening of the skid/tank 62 to the rail 10. The undercuts 33 provide the rail 10 with clearance for the wall 32 when the wall 32 is inserted into the channel 18.

The skid/tank 62 abuts against the lower surface of the base leg 12 and is attached thereto by passing fasteners 74 through the skid/tank 62 and through the apertures 76 in the base leg 12.

Therefore, the rail 10 is reversible and can be used in two different orientations which are 180 degrees relative to each other. By being reversible, the rail 10 can reduce a number of fasteners utilized in the overall assembly of the enclosure 100. In addition, the rail 10 allows the placement of fasteners such that the fasteners do not allow water to enter the enclosure 100 due to their through holes, and can reduce the overall cost of the enclosure by using common parts throughout the assembly.

It is to be noted that the apertures 34, 56, 72 and 76 can be pre-formed in the rail 10, or can be tapped when the fastener 36, 54, 56, 70, 74 is inserted through the rail 10.

Figures 8, 9, 10:
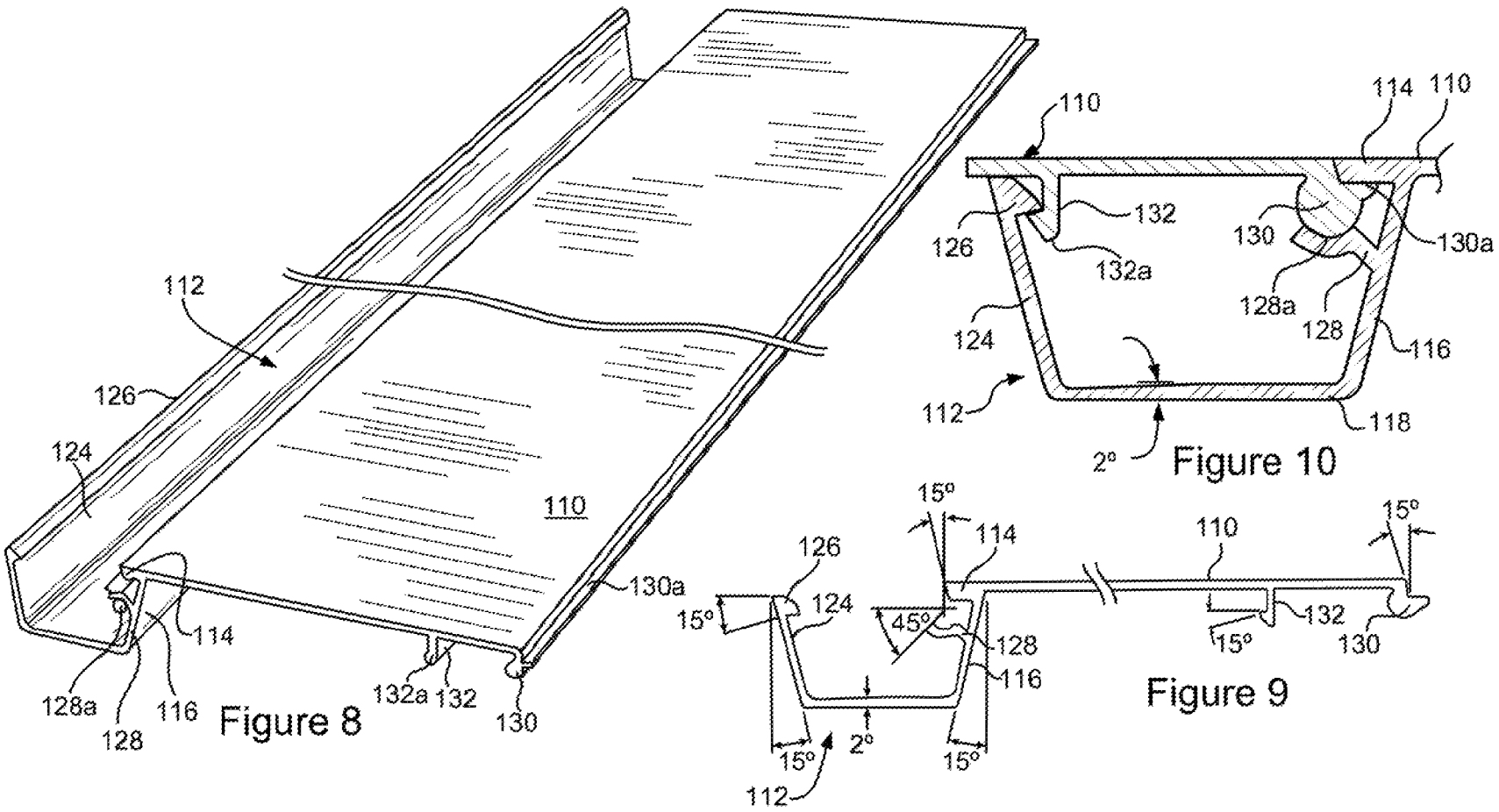
FIG. 8 is a perspective view of an example panel in which one or more panels can be used to form the wall and/or the roof.
FIG. 9 is an end elevation view of an example channel portion according to FIG. 8.
FIG. 10 is a sectional view of a channel portion of an example panel in interlocking engagement with interlocking elements of a companion panel.

FIG. 8 is a perspective view of an example construction panel 110 in which one or more panels 110 can be used to form the wall 32 and/or the roof 30. The panel 110 includes a longitudinal channel 112, and a longitudinal lip portion 114 which projects inwardly along channel 112, lip portion 114 being slightly thicker than the thickness of the balance of panel 110. Longitudinal lip portion 114 terminates in an outer edge which slopes downwardly and inwardly at an angle of 15° (see FIG. 9). Interior wall 116 of channel 112 slopes downwardly and outwardly, also at an angle of 15°. Wall 124 of channel 112 projects upwardly and outwardly from bottom 118, at an angle of 15°, and terminates in an inwardly projecting enlarged portion 126 having a flat bottom surface which projects slightly upwardly, and a convex arcuate upper surface, to facilitate interlocking with an adjacent panel.

The bottom 118 can be tapered, e.g., so that the interior wall 116 end is thicker than the wall 124. By tapering the bottom 118, the taper allows the profile to keep the wall 124 thick while still making the profile flexible for assembling. Keeping the wall 124 as thick as possible allows for a consistent, quality extrusion profile to be produced. The tapering can begin about a third of the length of the bottom 116 from the interior wall 116 end at a downward angle of about 2°. A thickness of the bottom 118 is about 2.49 inches at the wall 124. Other dimensions can be used. The tapering can be accomplished through aluminum extrusion. Molten aluminum is pushed through an extrusion die which shapes the aluminum to the desired profile. Additionally or alternatively, the tapering can be achieved by machining or casting.

A longitudinal inwardly projecting finger-like member 128 is integral with wall 116, finger-like member 128 terminating in a concavely curved portion 128*a*.

The longitudinal edge of panel 110 remote from channel 112 terminates in a downwardly extending, generally circular bead portion 130, having a forwardly projecting lip portion 130*a*. The portion of bead 130 above lip portion 130*a* extends upwardly and inwardly at an angle of 15°, as is seen most clearly in FIG. 9. Inwardly from bead 130, a longitudinally extending downwardly projecting finger 132 terminates in a thickened portion 132*a* which is generally triangular in cross-section, the bottom of the triangle being slightly rounded, and terminating in a flat surface at the top thereof, projecting inwardly from finger 132 proper. The upper surface of thickened portion 132*a* is flat and is in alignment with the bottom surface of enlarged portion 126 of wall 124, when in interlocking engagement.

To assemble a panel 110 into interlocking engagement with another panel 110, lip portion 130*a* of bead 130 is inserted under longitudinal lip portion 114, with thickened portion 132*a* of finger 132 being directly above the convex arcuate upper surface of enlarged portion 126 of wall 124. Manual pressure on the surface of panel 110 above finger 132 will cause the angled wall of finger 132 thereof to slide against the convex arcuate upper surface of enlarged portion 126 until locking is achieved when the panels 110 are interlocked as illustrated in FIG. 10. As lip 130*a* of circular bead 130 serves as a fulcrum, as panel 110 is levered downwardly, the circular bottom portion of bead 130 will come to its secure position inside concave trough portion 128*a* of member 128, as also illustrated in FIG. 10.

While the sizes of panels can be enlarged, pro rata, if the slopes of the channel sections are maintained no less than 15° and no greater than 18° it is possible to avoid a structure which is either too rigid, or too flexible respectively.

Referring to the convex arcuate upper surface of enlarged portion 126 of wall 124, it has if this curvature is too great, interlocking engagement with portion 132*a* of finger 132 becomes difficult, or if this curvature is made relatively flat, interlocking proves equally difficult.

The constructions permits a plurality of panels 110 to be readily enjoined in interlocking relationship such that when assembled, there is no necessity for separate structural frames. The shape of the panel sections disclosed above has been designed in order to achieve strength, economy of manufacture, ease of inter-locking, and permanency of inter-locked engagement.

Figure 11:
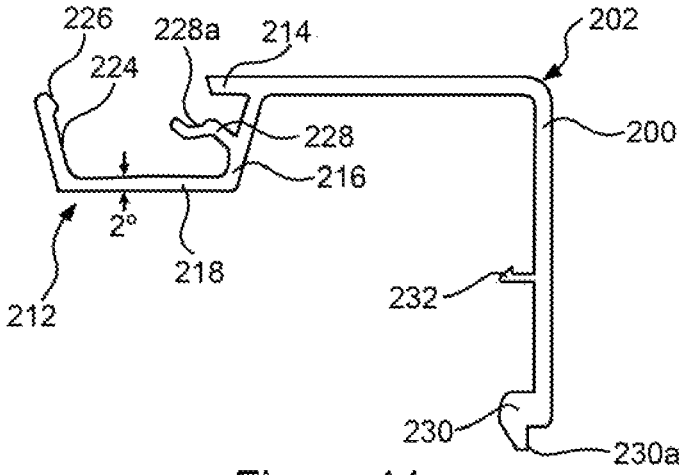
FIG. 11 is an end view of an example corner piece for interlocking companion panels at corners of the enclosure.

FIG. 11 is an end view of an example corner piece 200 for interlocking companion panels 110 at corners to create the enclosure. The corner piece 200 includes a longitudinal channel indicated generally at 212. Corner piece 200 includes a lip portion 214 which projects inwardly along channel 212. Lip portion 214 being slightly thicker than the thickness of the balance of corner piece 200. Longitudinal lip 214 terminates in an outer edge which slopes downwardly and inwardly at an angle of 15°. Interior wall 216 of channel 212 slopes downwardly and outwardly, also at an angle of 15°. Wall 224 of channel 212 projects upwardly and outwardly from bottom 218, at an angle of 15°, and terminates in an inwardly projecting enlarged portion 226 having a flat bottom surface which projects slightly upwardly, and a convex arcuate upper surface, to facilitate interlocking with an adjacent panel. Longitudinal inwardly projecting finger-like member 228 is integral with wall 216, member 228 terminating in a concavely curved portion 128*a*. In some implementation, the bottom 218 can be tapered 2° as described above for bottom 118.

The corner piece includes a 90° bend 202 to form a corner of corner piece 200. Other angle bends 202 can be used. An edge remote from channel 212 terminates in a downwardly extending, generally circular bead portion 230, having a forwardly projecting lip portion 230*a*. The portion of bead 230 above lip 230*a* extends upwardly and inwardly at an angle of 15°. Inwardly from bead 230, a longitudinally extending downwardly projecting finger 232 terminates in a thickened portion 232*a* which is generally triangular in cross-section, the bottom of the triangle being slightly rounded, and terminating in a flat surface at the top thereof, projecting inwardly from finger 232 proper.

Corner piece 200 can be used to assemble a panel 110 into interlocking engagement with another panel 110 at a corner. Lip 130*a* of bead 130 of panel 110 is inserted under longitudinal lip 214 of corner piece 200, with thickened portion 132*a* of finger 132 being directly above the convex arcuate upper surface of enlarged portion 226 of wall 224. Manual pressure on the surface of panel 110 above finger 132 will cause the angled wall of finger 132 thereof to slide against the convex arcuate upper surface of portion 226 of the corner piece 200 until locking is achieved when the panel 110 is interlocked with the corner piece 200. Likewise, lip 230*a* of bead 230 of corner piece 200 can be inserted under longitudinal lip 114 of another panel 110, with thickened portion 232*a* of finger 232 being directly above the convex arcuate upper surface of enlarged portion 126 of wall 124. Manual pressure on the surface of corner piece 200 above finger 232 will cause the angled wall of finger 232 thereof to slide against the convex arcuate upper surface of portion 126 of the other panel 110 until locking is achieved when the corner piece 200 is interlocked with the other panel 110, to connect two panels 110 at 90° with respect to each other. Other angles can be used.

Figure 12:
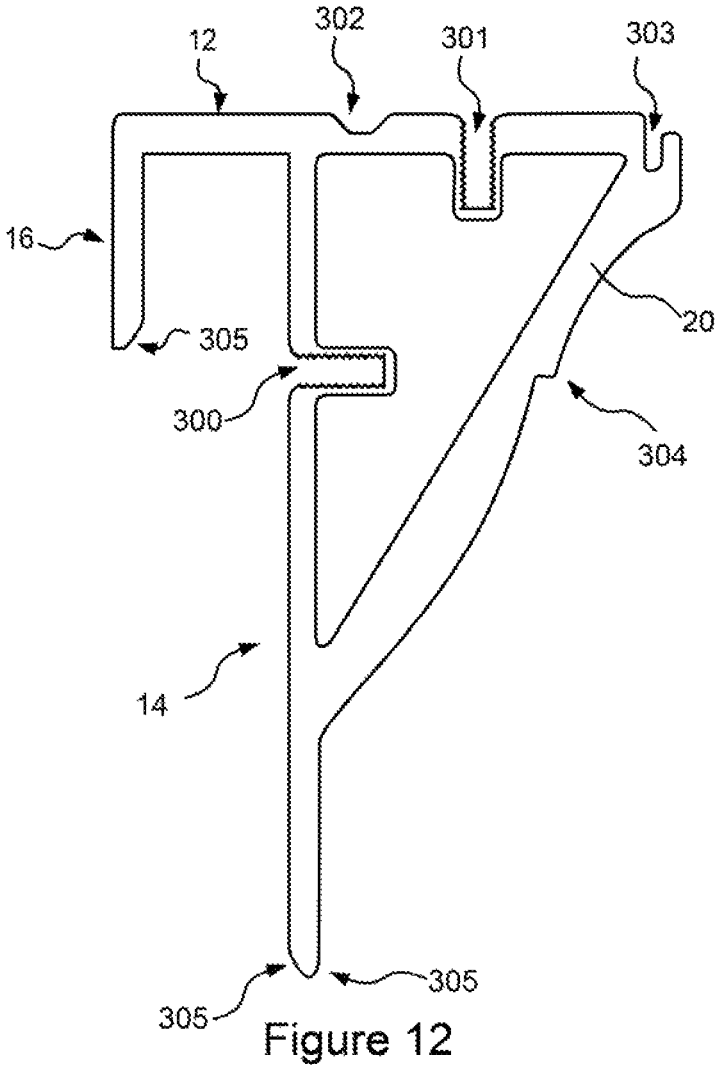
FIG. 12 is a cross sectional side view of another example rail.

FIG. 12 is a cross sectional side view of another example of a reversible rail 10. At least one aperture 300 can be formed through the vertical leg 14. In one example, the vertical leg 14 includes a first portion 14*a*, second portion 14*b* and third portion 14*c*, e.g., as in FIG. 2. The aperture 300 includes mimicking threads for a fastener to thread into. In one example, the aperture 300 does not extend all the way through the vertical leg 14. The aperture 300 can replace or be used in addition to the aperture 56 in FIGS. 1 and 2. Wall 32 is fastened to the rail 10 by passing a fastener 54 through the wall 32 and threading into the aperture 300.

Additionally or alternatively, aperture 301 can replace or be used in addition to aperture 34 in FIGS. 1 and 2. Aperture 301 can be formed in the second portion 12*b* of the base leg 12. In one example, the aperture 301 does not extend all the way through the vertical leg 12. The roof 30 is fastened to the rail 10 by passing a fastener 36 through the roof 30 and threading into each aperture 301. By incorporating apertures 300 and 301 into the rail 10, possible water entry points into the rail 10 can be eliminated.

Additionally or alternatively, the base leg 12 can include a notch 302 which extends along a length, or portion of the length, of the base leg 12. For example, the notch 302 can provide a guide edge for caulking before the roof 30 is placed on the base leg 12, e.g., to provide a seal against the environment. The notch 302 can be any shape, e.g., semi-circular, rectangular, triangular, half a hexagon, an irregular shape, etc.

Additionally or alternatively, gusset 20 can contain a notch 303 which extends along its length or portion of the length thereof. If desired, the notch 303 provides clip-in location for a cosmetic cover plate to be installed to cover seams which occur when two sections of reversible rail 10 abut each other. Additionally or alternatively, a geometry 304 of the gusset 20 can been modified to incorporate a decorative feature which extends along its length, e.g., a bracket shaped feature.

Additionally or alternatively, chamfers 305 can be formed at the end of legs 14 and/or 16. The chamfers 305 can provide a guide edge, e.g., for caulking after assembly to a roof and/or skid.

As used herein, fasteners can include bolts and nuts or other fasteners including screws, etc.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

Many modifications and other embodiments set forth herein will come to mind to one skilled in the art having the benefit of the teachings presented in the foregoing descriptions and the associated drawings. Although specific terms are employed herein, they are used in a generic and descriptive sense only and not for purposes of limitation.

The invention claimed is:

1. A rail for an enclosure, comprising:

a horizontal leg;

a first leg connected perpendicularly to the horizontal leg and a second leg connected perpendicularly to the horizontal leg and opposing the first leg, where the first leg and the second leg form a channel;

a gusset formed between the horizontal leg and the first leg, where the gusset defines a hollow opening; and an aperture formed in the horizontal leg, where the aperture is in communication with the hollow opening;

wherein the rail is alternatively positioned in a first orientation, in which the channel receives a bottom of a wall of the enclosure, the horizontal leg engages and is secured to a skid or tank of the enclosure, and the hollow opening is positioned on an inside of the enclosure, and a second orientation, in which the channel receives a top of the wall, the horizontal leg engages and is secured to a roof of the enclosure, the aperture is positioned above the hollow opening, and the hollow opening is positioned on an outside of the enclosure to act as a gutter for rain passing through the aperture and into the hollow opening.

2. The rail of claim 1, where the gusset includes a decorative feature.

3. The rail of claim 1, further including a notch formed in the gusset at the horizontal leg.

4. The rail of claim 1, where the aperture is configured for receiving a fastener to secure the roof to the horizontal leg.

5. The rail of claim 4, where the aperture includes threads for a fastener to thread into.

6. The rail of claim 1, where the horizontal leg is thicker at a position of the aperture than at other parts of the horizontal leg.

7. The rail of claim 1, further including an undercut feature formed in the channel between the horizontal leg and the first leg and the second leg, the undercut feature to provide clearance for the wall when the wall is inserted into the channel.

8. The rail of claim 1, further including a notch running along the horizontal leg to provide a guide for caulk.

9. The rail of claim 1, where the first leg includes a flange portion to support the wall.

10. The rail of claim 1, further including a second aperture formed in the first leg.

11. The rail of claim 10, where the second aperture includes threads for a fastener to thread into.

12. The rail of claim 1, further including a chamfer formed in an end of at least one of the first leg and the second leg.

13. The rail of claim 1, wherein one of the first leg and the second leg is longer than the other of the first leg and the second leg.

14. The rail of claim 1, wherein the first leg is longer than the second leg.

15. An enclosure, comprising:

a wall formed of a construction panel and a like panel, wherein the wall has a top and a bottom, the construction panel including a first interlock member comprising a generally cylindrical bead-like member adapted to be received in a trough-like portion and a projecting lip adapted to act as a fulcrum against a first inwardly projecting member to slightly deflect a second inwardly projecting member as the construction panel is levered into interlocking engagement with the like panel; and a rail including a horizontal leg connected perpendicularly with a vertical leg, and a gusset formed between the horizontal leg and the vertical leg and defining a hollow opening, wherein the horizontal leg includes an aperture formed in the horizontal leg, wherein the aperture is in communication with the hollow opening, wherein the rail is alternatively positioned in a first orientation, in which the rail engages the bottom of the wall, the horizontal leg engages and is secured to a skid or tank of the enclosure, and the hollow opening is positioned on an inside of the enclosure, and a second orientation, in which the rail engages the top of the wall, the horizontal leg engages and is secured to a roof of the enclosure, the aperture is above the hollow opening, and the hollow opening is positioned on an outside of the enclosure to act as a gutter for rain passing through the aperture and into the hollow opening.

* * * * *